US005974993A

United States Patent [19]

DeFranks et al.

[11] Patent Number: 5,974,993

[45] Date of Patent: Nov. 2, 1999

[54] QUILTED BORDER WINDER APPARATUS, SYSTEM AND METHOD

[75] Inventors: Michael S. DeFranks, Decatur; Jerrol L. Studdard, Lawrenceville, both of Ga.

[73] Assignee: Simmons Company, Atlanta, Ga.

[21] Appl. No.: 08/941,690

[22] Filed: Oct. 1, 1997

[51] Int. Cl.[6] ..... D05B 11/00; B65H 75/38

[52] U.S. Cl. ..... 112/117; 242/388.7

[58] Field of Search ..... 112/2.1, 117, 118, 112/119, 307, 470.33, 470.36, 475.07, 475.08; 242/166, 160.2, 389, 388.6, 388.7, 399, 399.2, 398, 17, 531, DIG. 2, 471

[56] References Cited

U.S. PATENT DOCUMENTS

| | | | |
|---|---|---|---|
| 1,804,585 | 5/1931 | Barner et al. | 242/389 |
| 2,318,686 | 5/1943 | Hathaway | 112/117 X |
| 4,284,249 | 8/1981 | Legallasi et al. | 242/388.7 |
| 4,477,035 | 10/1984 | O'Connor | 242/471 |
| 4,621,777 | 11/1986 | O'Connor | 242/160.2 |
| 4,759,512 | 7/1988 | Gaiser | 242/471 |
| 5,694,875 | 12/1997 | Cash | 112/470.33 |

*Primary Examiner*—Ismael Izaguirre
*Attorney, Agent, or Firm*—Jones, Day, Reavis & Pogue

[57] ABSTRACT

A quilted border winder apparatus, a quilted border system and a method of making quilted borders that includes two machine halves in which a number of independent wind-up stations are radially mounted and longitudinally spaced about the axis of a main shaft for each half and in which each wind-up station is connected to the shaft by an arm. Each machine half contains an identical shaft and the two shafts are parallel, but are laterally offset one from the other. Each wind-up station is driven by an electric motor utilizing a gear box and a chain/sprocket assembly that is connected to the wind-up station through the interior of the connecting arm.

22 Claims, 9 Drawing Sheets

QUILTED BORDER WINDER APPARATUS, SYSTEM AND METHOD

BACKGROUND OF THE INVENTION

1. Field of the Invention

The present invention relates to a quilted border system and a method used in the manufacture of a border section for the outer layer of mattresses and box springs. More particularly, this invention relates to a system, a border winder apparatus and the method for manufacturing quilted borders for mattresses and box springs in a simple, reliable and efficient manner.

2. Description of the Related Art

In the bedding products industry, it is common to produce mattresses and/or box springs having finished outer surfaces constructed with ornate fabric, called "ticking", that is quilted with layers of foam and/or other synthetic resin materials. A typical mattress or box spring has a top surface, a bottom surface and four sides between the top and bottom surfaces. The connecting sides are commonly referred to as the "border" of the mattress or box spring. The border is typically constructed of a strip of quilted ticking and is referred to as a "quilted border."

Traditionally, quilted border material was made with a quilting machine in conjunction with a roll winding machine or "winder." A full-width roll of ticking, approximately eight feet wide is fed into the quilting machine and, upon exiting the now quilted ticking is cut into varying widths, usually 7 to 15 inches, appropriate for use as border material for a mattress or a box spring. After the quilted ticking is cut into widths, each of the resulting border strips is simultaneously wound onto a common shaft of the winder. Upon completion of the quilting, cutting and winding of an entire roll of ticking, the shaft is removed from the winder and each roll of border material is removed from the shaft and is used to construct finished mattresses or box springs or is stored as inventory. During this removal process, the quilting machine, the cutting machine and the winder must be brought to a halt so that the finished border rolls may be removed. Thereafter, the shaft is replaced and a new full-length roll of ticking is fed into the machinery and the process cycle is begun again.

The process just described is moderately efficient when large quantities of a single type of quilted border material are needed for immediate production. However, problems exist with this process. One problem is the time lost during changeovers when one roll of quilted ticking is removed and a new roll of ticking is installed. The operator is required to remove a large, heavy shaft containing a number of border rolls. Another problem occurs because the border material is cut into individual border strips after quilting occurs. A quantity of border material suffers from "run-back skips," a term referring to an edge defect. This defect occurs when a seam in a piece of quilted ticking is cut while the thread comprising the seam is under tension. Because the thread is under tension, it quickly loosens and the edge of the quilted ticking may separate. Another potential problem is that a portion of the strip of quilted ticking may "gather" or "bunch." Either of the last two mentioned conditions renders the resulting border material defective.

In addition to the preceding problems, the demands of the marketplace have led to additional problems. Manufacturers are required to offer a large variety of ticking material of different quality levels and having different weaves and printed patterns. Also, a manufacturer often receives orders for bedding products requesting a variety of such ticking materials. This requires the production of a number of different products within a short period of time. Also, during periods of production of large quantities of bedding products containing more popular ticking material, manufacturers are often required to fill smaller orders for less popular material or even to fill a small order for a product containing a particular of ticking on a "quick-ship" basis.

A manufacturer will also occasionally have to produce additional border material containing a different type of ticking to repair damaged borders on completed mattresses and box springs. When traditional manufacturing techniques are employed, these conditions have increased inventory levels of less popular or unused border material due to the requirement that a full-width roll must be run. Productivity is lowered due to the lost time associated with increased changeovers of rolls and increased material handling given the large number of individual border rolls per full-width roll. Furthermore, aesthetics suffer due to the increased number of splices required in the finishing product because of the increased number of shortened border strips produced when a full-width roll is interrupted for a small order production.

A definite need has existed for solutions to these problems. Until now a workable, efficient solution could not be found.

BRIEF DESCRIPTION OF THE INVENTION

The difficulties encountered with previous systems have been overcome by the present invention. What is described here is a quilted border winder apparatus comprising a base, a plurality of take-up reels, each of said reels is positioned to receive a quilted strip of ticking, means mounted to the base for supporting the take-up reels and means supported by the base for rotating each take-up reel independently.

The invention also includes a method of quilting borders for mattresses and the like comprising the steps of providing a plurality of individual ticking strip rolls, providing a roll of other material to be quilted, placing the plurality of ticking strip rolls in a divided support structure, each roll separated from another, quilting the strips of ticking and the other material in a quilting machine, separating each quilted strip of ticking and other material from other quilted strips of ticking and other material, independently rolling each separated quilted strip of ticking and other material on a winding machine and independently moving a roll of quilted strip of ticking and other material from the winding apparatus.

The invention also includes a quilted border system comprising a ticking support station having dividers for separating rolled strips of ticking, a quilting machine operatively connected to the ticking support station for connecting the strips of ticking to other material to form quilted borders, cutting means operatively connected to the quilting machine for separating each quilted border strip prior to winding and an apparatus having a plurality of winding stations each being separately powered and each being positioned to receive a quilted border strip independently of other quilted border strips.

An object of the present invention is to provide a system, apparatus and method which are simple, reliable and efficient. An advantage of the present invention is to provide a system, apparatus and method which increases productivity, reduces inventory and relieves material handling. A further aspect of the present invention is to provide a system, apparatus and method which improves quality of quilted borders and yet provides the flexibility to efficiently and effectively handle small orders on short notice.

A more complete understanding of the present invention and other objects, aspect, aims and advantages thereof will be gained from a consideration of the following description of the preferred embodiment read in conjunction with the accompanying drawings provided herein.

DETAILED DESCRIPTION OF THE PREFERRED EMBODIMENT

Figure 2:
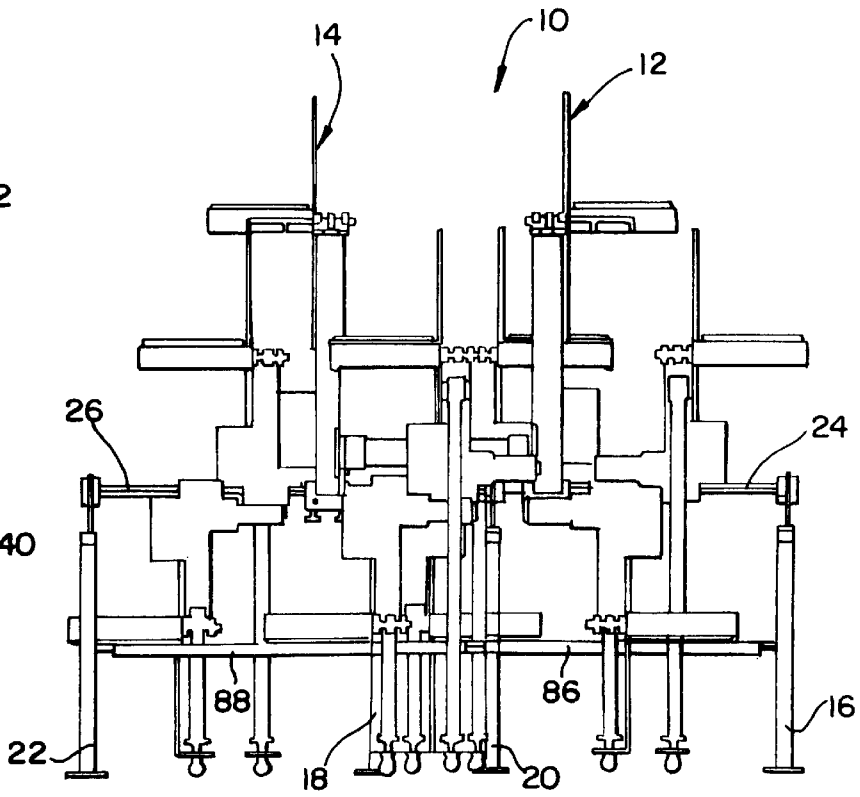
FIG. 2 is a front elevational view of the winder apparatus of FIG. 1.

While the present invention is open to various modifications and alternative constructions, the preferred embodiment shown in the drawings will be described herein in detail. It is to be understood, however, that there is no intention to limit the invention to the particular form disclosed. On the contrary, the intention is to cover all modifications, equivalent structures and methods and alternative constructions falling within the spirit and scope of the invention as expressed in the appended claims.

Figure 1:
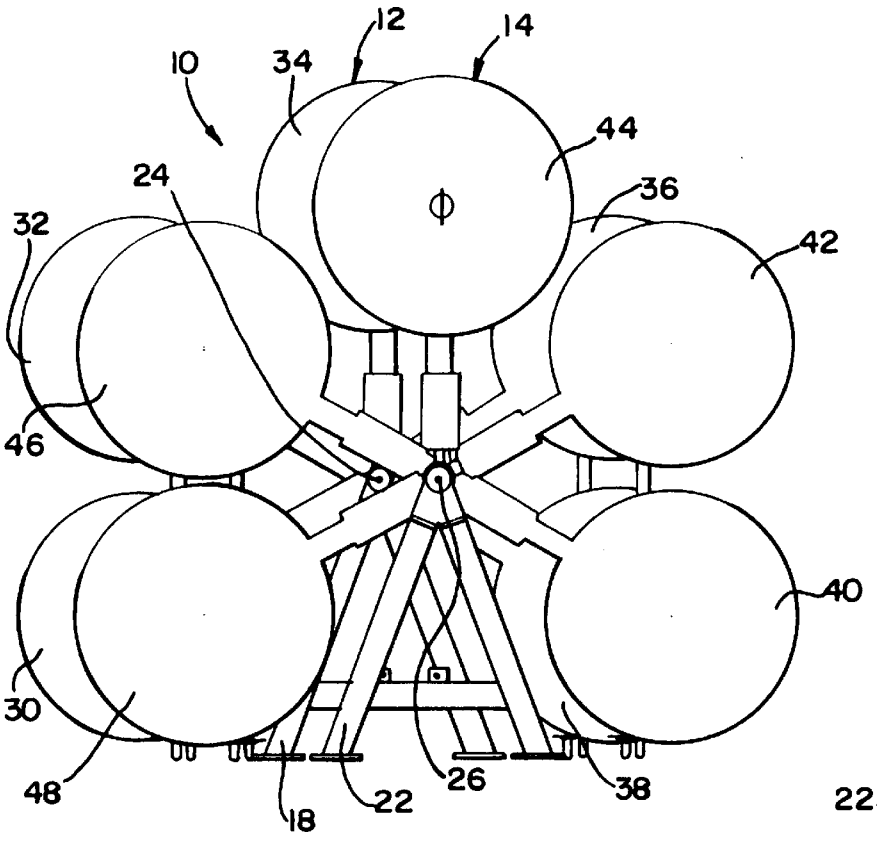
FIG. 1 is a diagrammatic side elevational view of a border winder apparatus constructed in accordance with the principles of the present invention.
Figure 9:
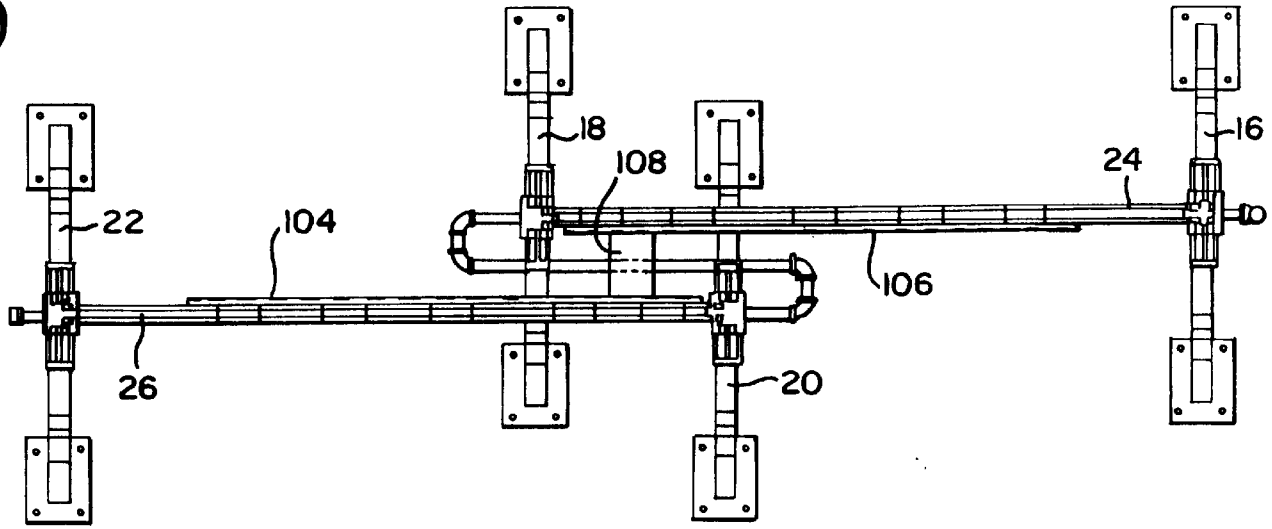
FIG. 9 is a top plan view of the electrical conduit assembly and support structure shown in FIG. 8.

Referring now to FIGS. 1 and 2, a quilted border winding apparatus 10 is shown in elevation and is built in two sections 12 and 14 which are essentially mirror images of one another. However, the sections are offset and overlap. The offset is best seen in FIG. 1 and the overlap is best seen in FIG. 2. Each section includes two A-shaped support bases, such as support bases 16 and 18 for the section 12 and support bases 20 and 22 for the section 14. Mounted to each pair of support bases is a horizontally disposed main shaft, such as the shaft 24 between the bases 16 and 18 and the shaft 26 between the bases 20 and 22. The main shafts are parallel to one another, but are offset as shown in FIGS. 1 and 9. Five independent wind-up stations are mounted radially about each main shaft, and each wind-up station is mounted to a support arm. For example, the wind-up stations 30, 32, 34, 36 and 38 are mounted to the shaft 24 and the wind-up stations 40, 42, 44, 46 and 48 are mounted to the shaft 26. Rotational movement is imparted to each wind-up station through the use of a motor, a gearbox, two sprockets and a connecting chain. The offset and overlap of the sections provides access for an operator to each wind-up station and a minimum amount of floor space is consumed.

In accordance with the present invention, the border winder apparatus is employed as part of a system where pre-cut rolls of ticking strips, usually 7 to 15 inches wide, foam material and backing material are fed into a quilting machine. The resulting strips of quilted border material are then individually and independently collected upon different wind-up stations, forming rolls of quilted border material. To accomplish this, a number of individual rolls of ticking strips, up to ten with the apparatus as shown, are pre-cut into desired predetermined widths. The individual rolls of ticking strips can represent a variety of ticking designs, qualities and widths, or the rolls can all be of identical ticking. The individual pre-cut rolls are then fed into the quilting machine in a parallel manner and are secured independently to the individual wind-up stations of the border winder apparatus. Once all rolls are secured and aligned, the quilting machine and border winder apparatus are energized and each individual border strip is wound at a specific wind-up station. It should be noted here that a new ticking roll may be added to the system at any time to replace an exhausted roll or to replace a partially used roll while at the same time other ticking rolls are being quilted and wound. There is no need to stop the quilting and winding operations as they relate to the other rolls. This feature offers a substantial savings in time.

Figure 4:
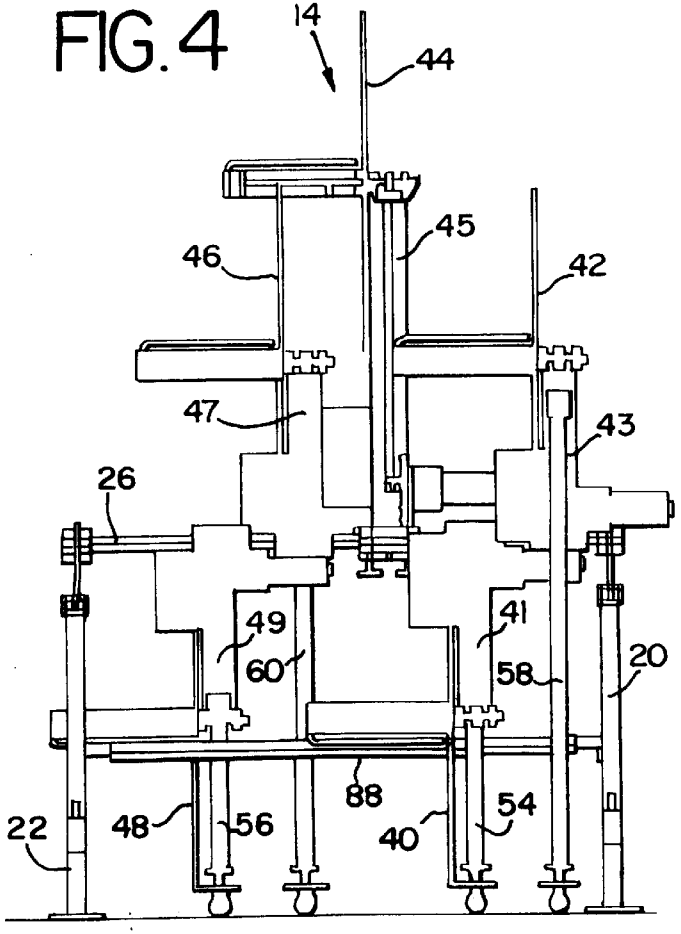
FIG. 4 is a front elevational view of the winder apparatus section shown in FIG. 3.
Figure 3:
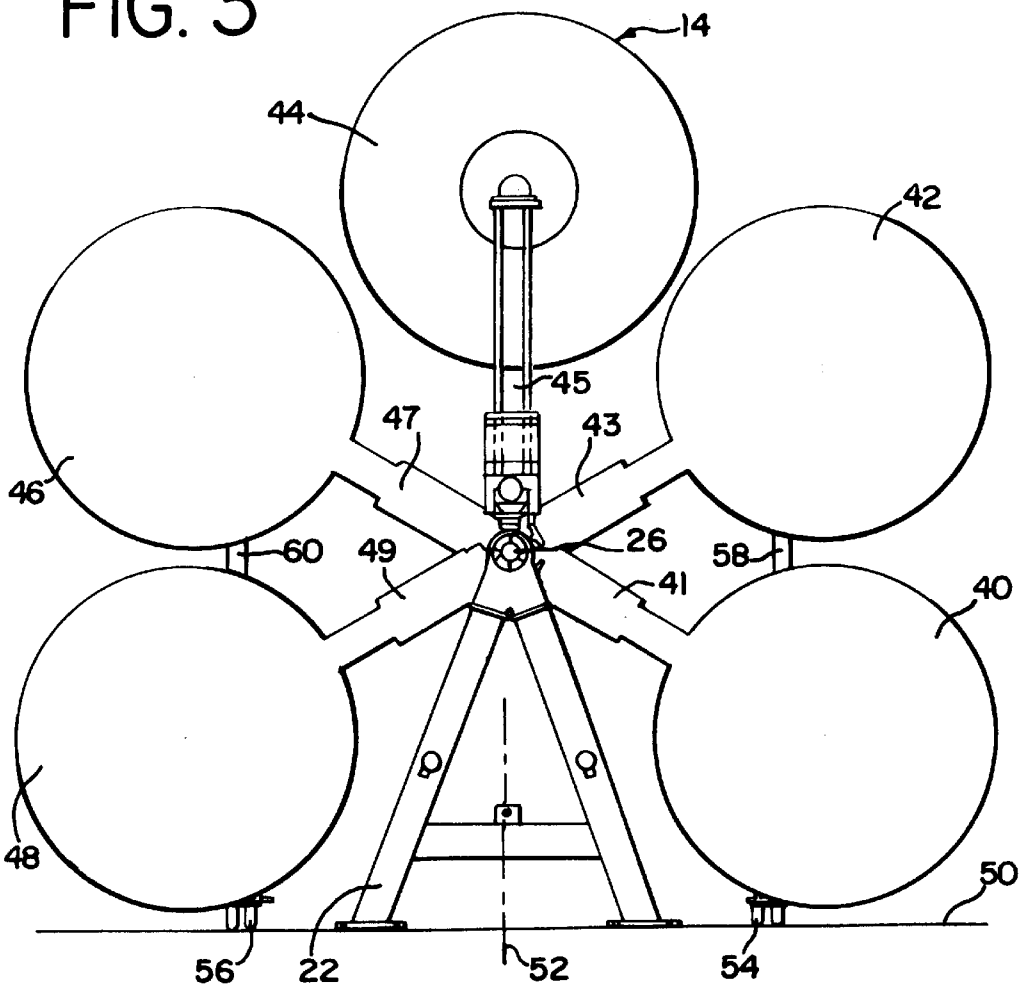
FIG. 3 is a slightly enlarged diagrammatic side elevational view of a section of the winder apparatus of FIG. 1.

Referring now to FIGS. 3 and 4, it may be appreciated that each wind-up station is spaced approximately every 60° starting from a vertical reference plane, labeled 52. The stations 40 and 48 closest to the floor are supported by arms 41 and 49, respectively, and by short support legs 54 and 56, respectively. The next pair of higher stations 42 and 46, spaced about 120° from the vertical reference and about 60° from the lower stations 40 and 48, respectively, are supported by arms 43 and 47, respectively, and by long support legs 58 and 60, respectively. The highest mounted station 44 is "straight up" and is supported by an arm 45 only.

Each of the main shafts 24, 26 has a hexagonal cross section to facilitate angular orientation of the wind-up stations, one being 60° from another starting with the wind-up station 48 and moving clockwise to the wind-up stations 46, 44, 42 and 40. The number of wind-up stations that are utilized in normal operation could range from six to ten stations. Five stations are supported by each of the two shafts and station usage is dependent upon need. Each wind-up station is also spaced apart from one another in a direction parallel to the axes of the shafts as can be seen in FIG. 4. Each main shaft is constructed from steel and is about 1.5 inches across.

Figure 7:
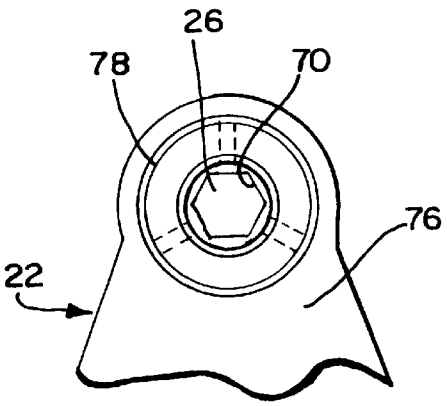
FIG. 7 is an enlarged side elevational view of a portion of the support base shown in FIG. 5.
Figure 6:
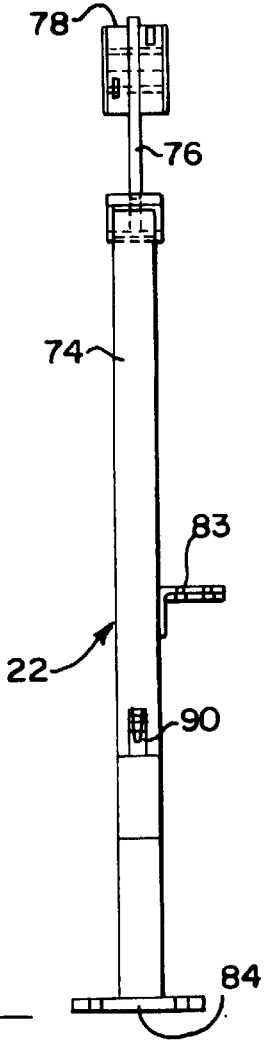
FIG. 6 is a front elevational view of the support base shown in FIG. 5.
Figure 5:
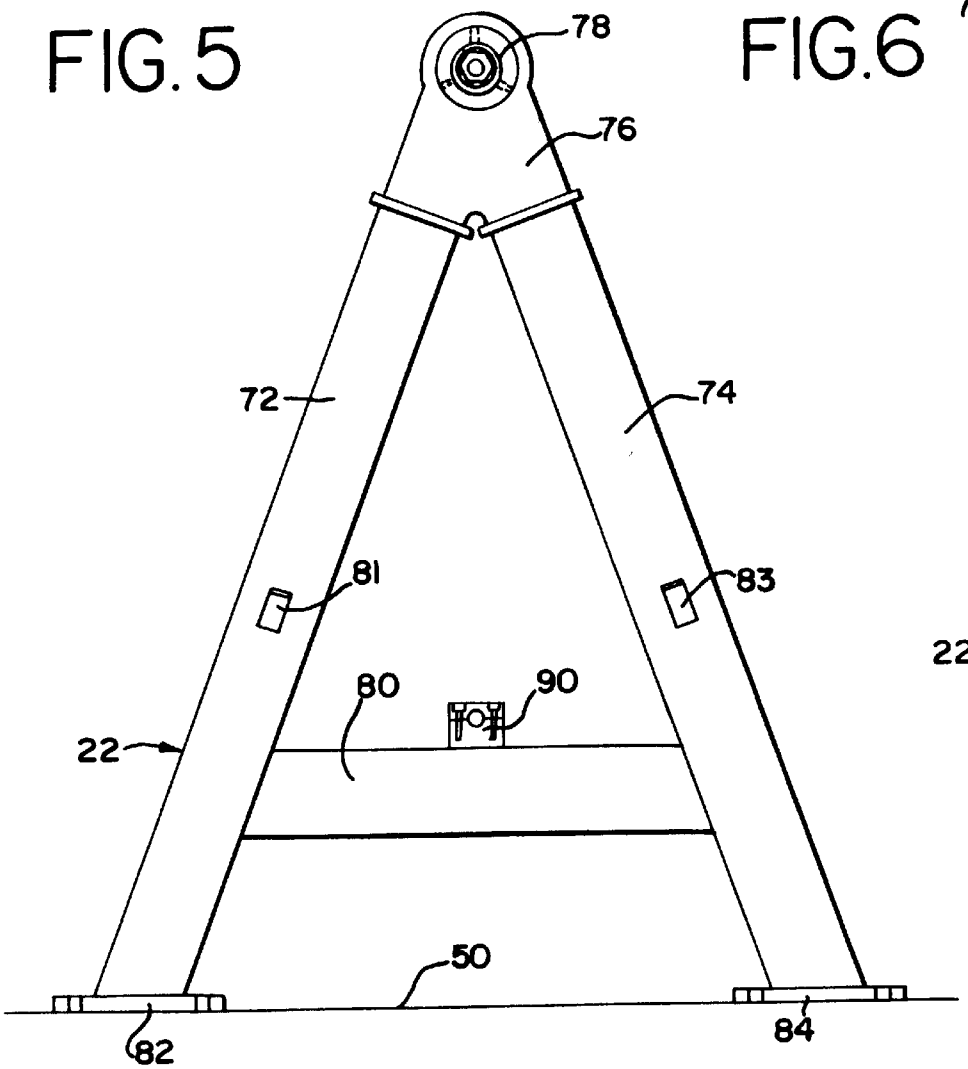
FIG. 5 is a side elevational view of a support base of the winder apparatus shown in FIGS. 1 and 2.

Referring now to FIGS. 5, 6 and 7, each of the main shafts 24, 26 is mounted to respective support bases, the shaft 24 to the support bases 16 and 18 and the shaft 26 to the support bases 20 and 22. Attachments is by way of hexagonal bushings, such as the bushing 70. The bushing 70 is mounted in a typical fashion to the support base 22. Using the support bases 22 by way of example for all of the support bases, it is A-shaped having two diverging legs 72, 74 that are fabricated of rectangular, tubular steel. The legs converge at an inverted Y-shape plate 76, fabricated of steel, with a cylindrical hub 78 into which the hexagonal bushing 70 is press-fitted. The Y-plate is attached to the legs by welding. The legs are joined together by a cross brace 80, to complete the "A", which is fabricated of rectangular, tubular steel and which is attached to the legs by welding. Each leg has a floor-mounting plate, such as plates 82, 84, that are attached by welding to the end of a respective leg opposite the end attached to the Y-plate. The floor-mounting plates 82 84 allow the border winder apparatus 10 to be solidly attached to a floor 50 in a manufacturing facility.

Each support base has a small leg flange, such as the flanges 81, 83 attached to each of its legs, by welding the flange into a position that is approximately on the centerline of each leg and at approximately its mid-point. The flanges serve to attach lower support roller assemblies 86, 88 (FIG. 2) to the base legs. The lower support roller assemblies are positioned parallel to the main shafts 24,26. Each assembly includes a steel rod covered with a loose-fitting polyvinyl chloride tube. The ends of the rod contain radially drilled holes through which each end of the rod is attached to a flange on a pair of the support bases. Each support base also has a clamp, such as the clamp 90, attached to the cross-brace by welding. The clamps are used to mount an electrical conduit assembly.

Figure 8:
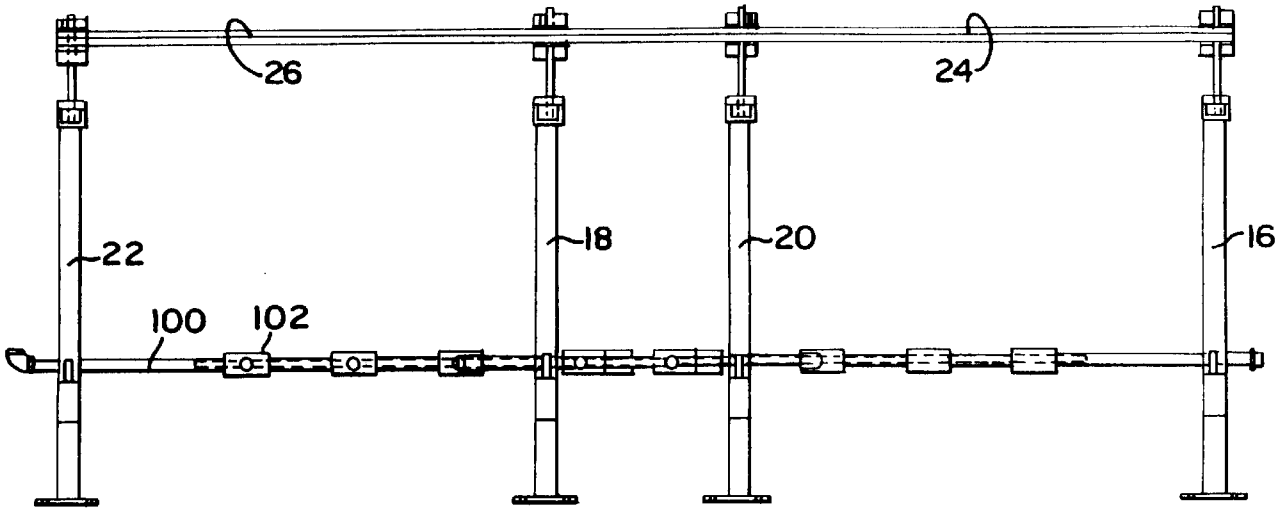
FIG. 8 is a front elevational view of an electrical conduit assembly and support structure of the present invention.

Referring now to FIGS. 8 and 9, the border winder apparatus is supplied with electrical power in the form of alternating current through a standard tubular conduit assembly 100, and each wind-up station is supplied with electrical power through a standard 120V/60 Hz AC receptacle, such as the receptacle 102. The conduit assembly 100 is supported by a conduit support skeleton including two steel bars 104, 106 and a steel cross-plate 108. The conduit support skeleton is attached to the conduit assembly by a series of U-bolts (not shown) spaced evenly along the conduit assembly, four U-bolts per section.

Figure 10:
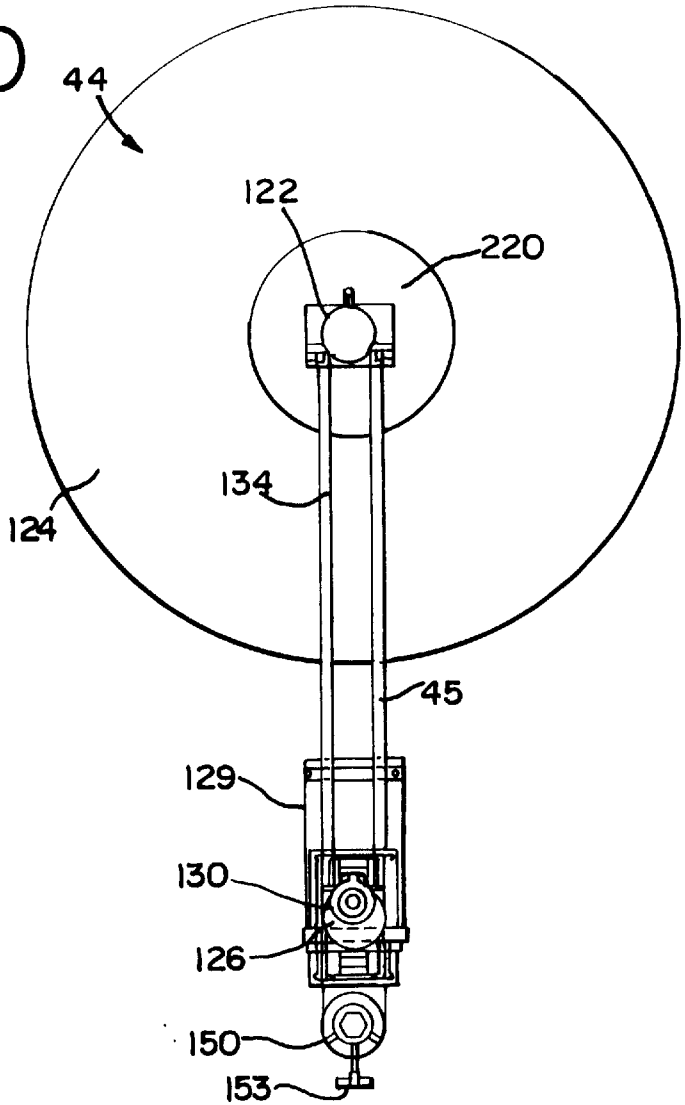
FIG. 10 is an enlarged side elevational view of a wind-up station of the present invention.
Figure 11:
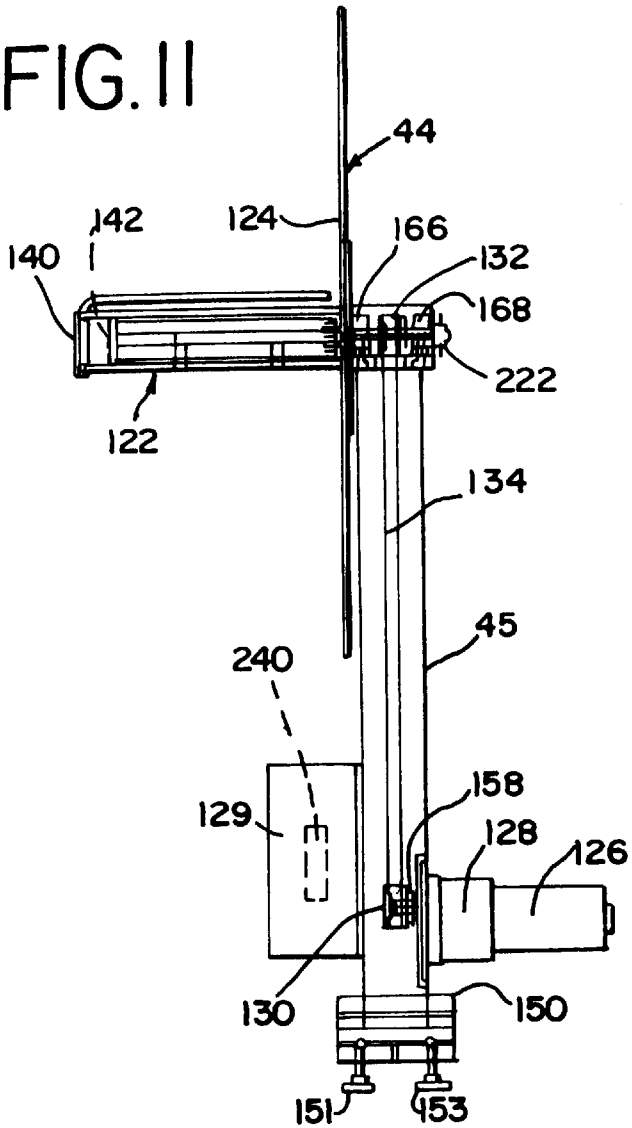
FIG. 11 is a front elevational view of the wind-up station shown in FIG. 10.

Referring to FIGS. 10 and 11, each wind-up station may be driven independently by a drive system that is a combination of an electric motor, a gearbox and a poly-chain/sprocket assembly. For example, the station 44 will be described in detail as it is typical of all of the stations. The station is supported by the arm 45 connected to the main shaft 26 at one end and to a take-up reel 122 and a guide plate 124 at the opposite or extended end. A motor 126 and a gearbox 128 are connected to the arm adjacent the main shaft and a variable speed motor controller 240 is contained in a housing 129 attached to the arm on the opposite side of the motor and the gearbox. The motor is a DC motor used in conjunction with a gear box ratio of 240:1 that can obtain a maximum output speed of 10.8 rpm with an input motor horsepower of approximately ⅛th HP.

The motor drives the take-up reel 122 via two sprockets 130, 132, having a 1:1 ratio, and a poly-chain 134. The sprockets and poly-chain are located within the interior of the arm. The drive system may be controlled by the variable speed controller that simulates torque control by utilizing each station's electric current draw. During winding operations, each take-up reel rotates at an initial speed of approximately eight rpm. However, as the strip of quilted border grows to a roll of ever increasing diameter, the reel slows to a final speed of less than one rpm. This variable speed concept has the marked advantage that the winds at the interior of the roll are not squeezed. This would happen if the reel rotated at a constant speed. Finally, the take-up reel includes a light-weight, removable sleeve 140 mounted to a core 142. This arrangement has the advantage of allowing for the quick and easy removal of a quilted border roll from a wind-up station without requiring tools.

Figure 13:
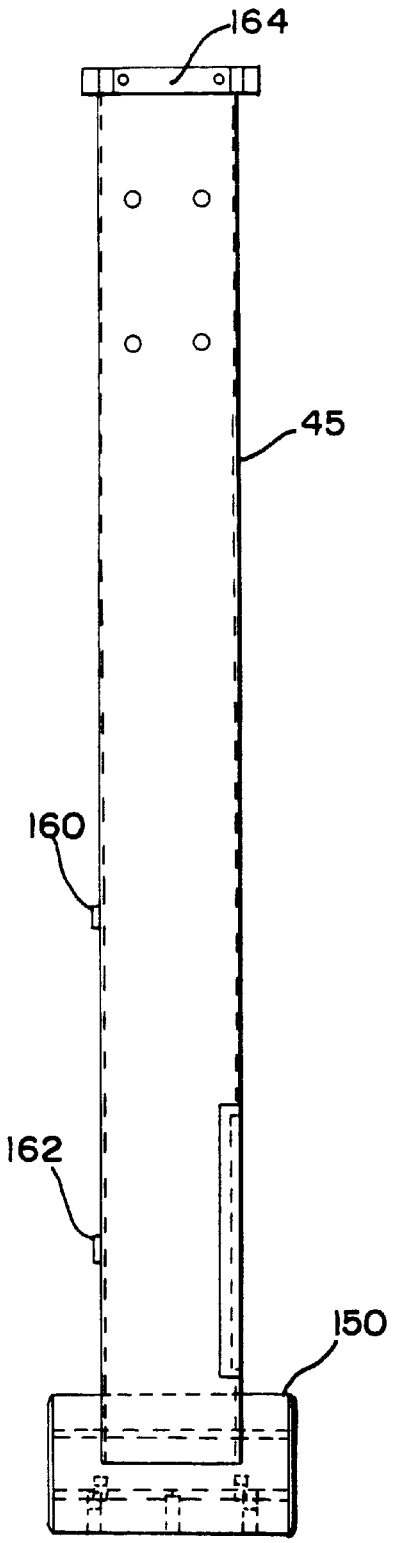
FIG. 13 is a front elevational view of the arm shown in FIG. 12.
Figure 12:
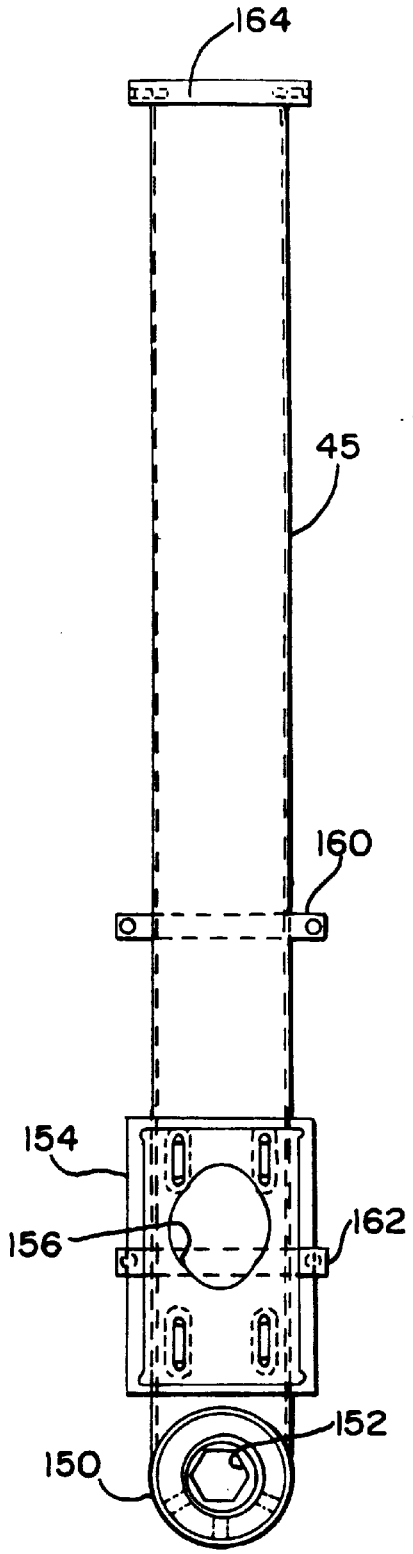
FIG. 12 is an enlarged side elevational view of an arm for supporting the wind-up station.
Figure 15:
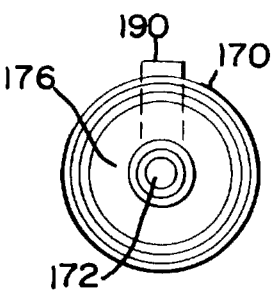
FIG. 15 is a side elevational view of the core shown in FIG. 14.
Figure 14:
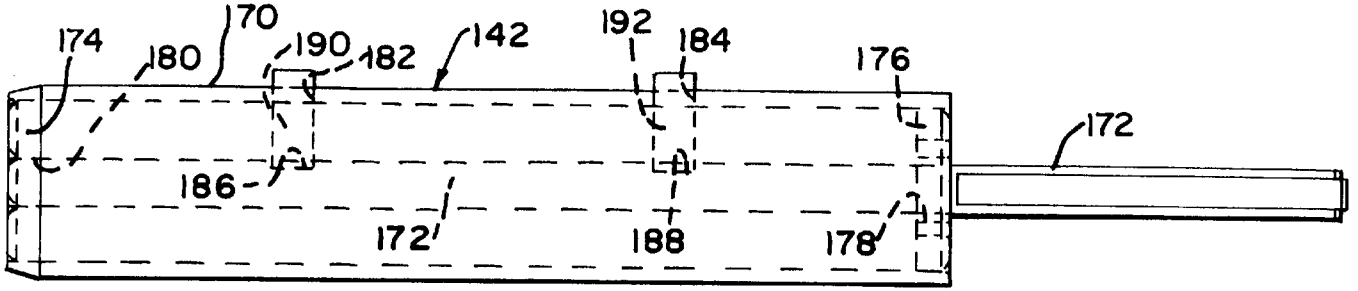
FIG. 14 is an enlarged front elevational view of a core of the wind-up station.
Figure 17:
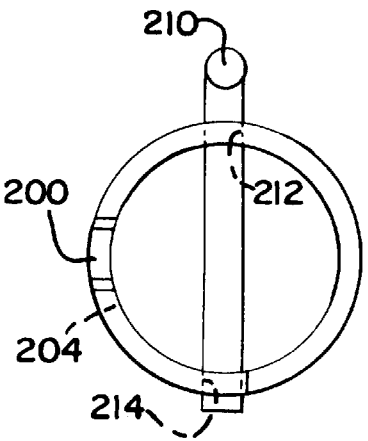
FIG. 17 is a side elevational view of the sleeve shown in FIG. 16.
Figure 16:
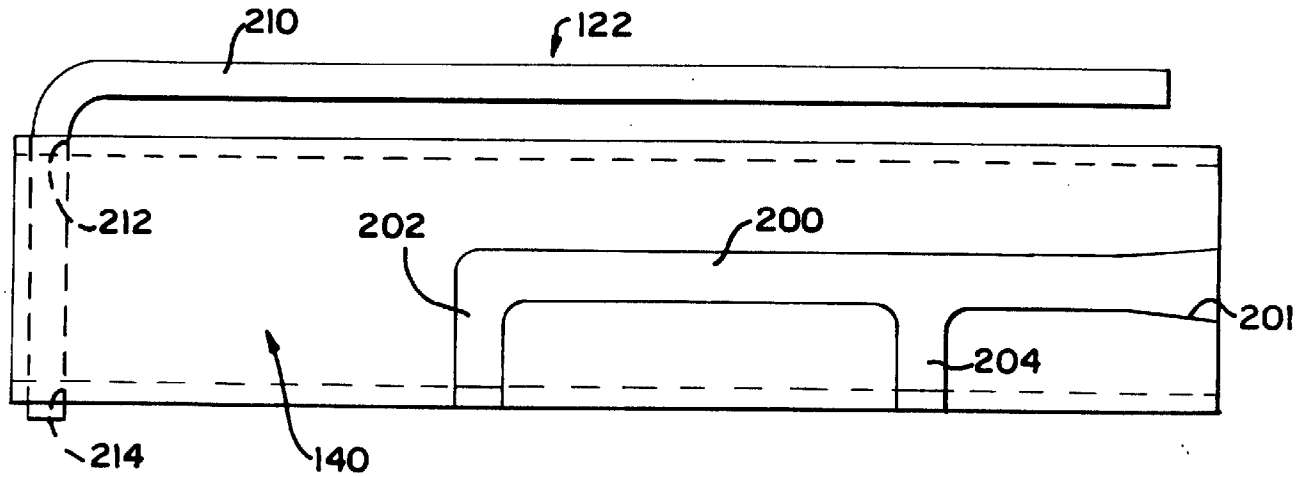
FIG. 16 is an enlarged front elevational view of a sleeve of the wind-up station.
Figure 19:
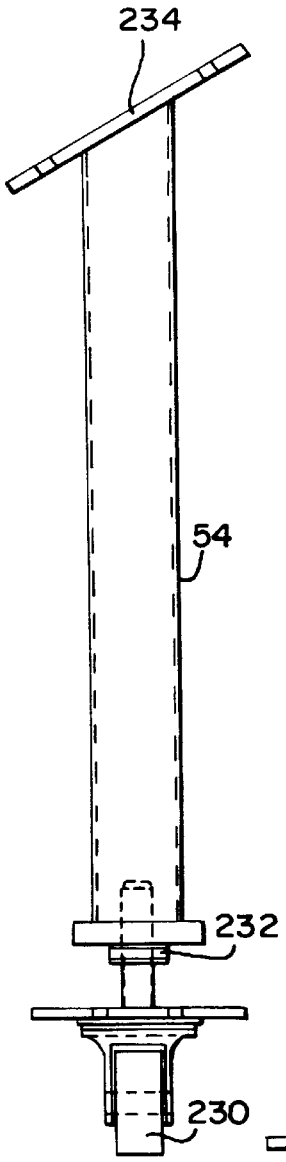
FIG. 19 is a side elevational view of the short support leg shown in FIG. 18.
Figure 18:
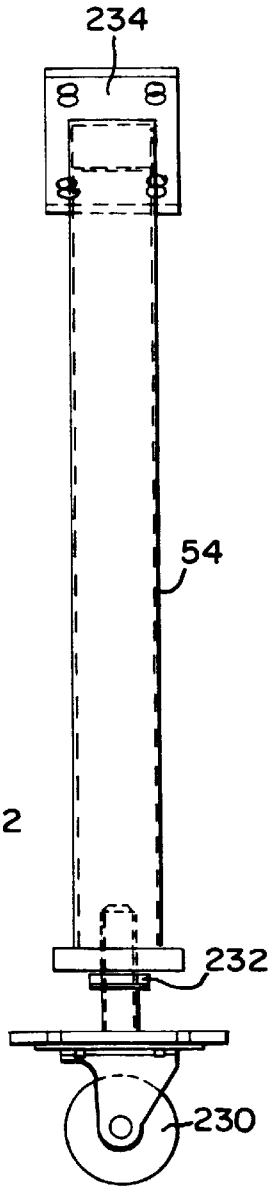
FIG. 18 is an enlarged front elevational view of a short support leg of the present invention.
Figure 21:
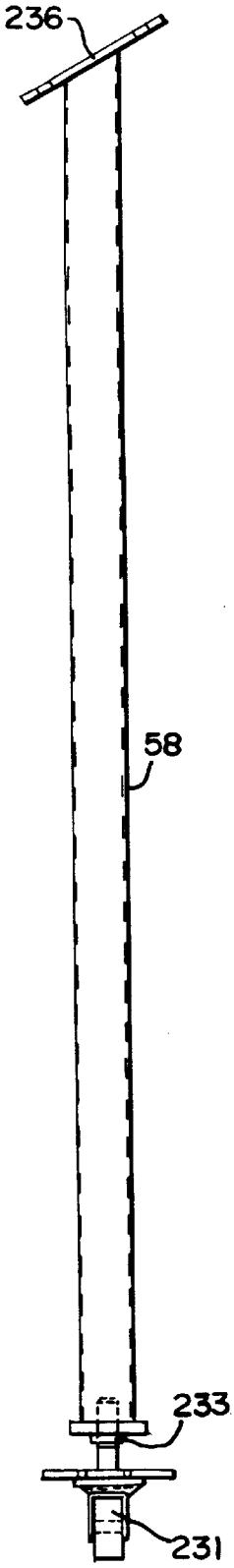
FIG. 21 is a side elevational view of the long support leg shown in FIG. 20.
Figure 20:
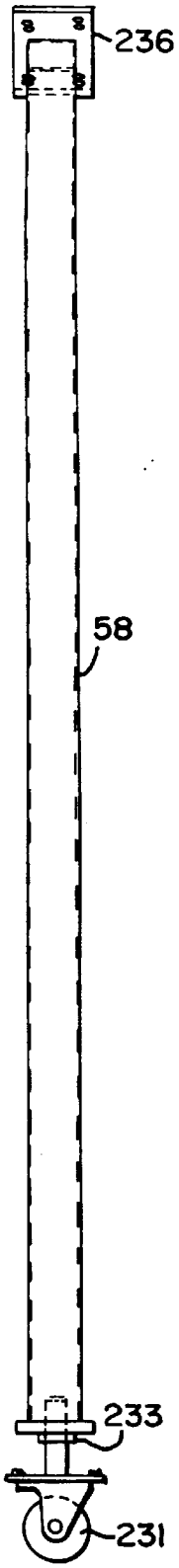
FIG. 20 is an enlarged front elevational view of a long support leg of the present invention.

Turning to FIGS. 11, 12 and 13 each of the wind-up stations is adjustably attached to one of the two main hexagonal shafts 24, 26 by an arm, such as the arm 45. Each arm may be fabricated of rectangular, tubular aluminum. By way of example, the arm 45 has an aluminum hub 150 into which a Duralon hexagonal shaped bearing 152 is shrink-fitted. Duralon bearings are self-lubricating, with a woven Teflon fabric liner, backed by a filament wound fiberglass and epoxy resin. The arm is adjustably attached to the main shaft 26 and may be laterally adjusted by sliding the arm along the main shaft on the bearing. Once a position is chosen along the shaft, hand operated set screws 151, 153 are tightened against the shaft. The arm has a motor mounting plate 154 for receiving the DC motor/gear 126,128. The motor mounting plate has an opening 156 through which a motor/gear output shaft 158 may pass into the interior of the arm. The arm also has two controller box bars 160, 162 for mounting the DC motor controller 240 and the housing 129. The arm also includes a bearing plate 164 attached at its extended end for receiving two pillow-block bearings 166, 168 and used for mounting the reel 122.

Referring to FIGS. 14, 15, 16 and 17, each wind-up station includes the take-up reel, and each reel, such as the reel 122 includes an inner core element and an outer sleeve, such as the core 142 and the sleeve 140. The inner core is fabricated from a generally cylindrical steel tube 170 and an extending steel shaft 172. Two steel, washer-like end caps 174 and 176 are attached to the tube by welding so that the end caps are flush with the ends of the tube. The core shaft 172 is positioned in a hole 178 in the end cap 176 and in a hole 180 in the end cap 174. The core shaft may be attached to the end caps by welding.

The core tube 170 has two radially milled or bored holes 182 and 184 that are aligned with two radially milled or bored holes 186 and 188 in the core shaft 172. Two pins 190 and 192 are press-fitted through the holes 182 and 184, respectively, in the tube and further press-fitted into the holes 186 and 188, respectively, in the shaft. These pins 190, 192 allow for the locking of the core 142 and the sleeve 140 without the need for tools or additional hardware.

The sleeve 140 is fabricated of a single piece of cylindrical aluminum tubing. The sleeve has a longitudinally directed guide channel 200 which serves to guide the sleeve onto the core and to lock the sleeve to the core in a quick and simple manner. The guide channel has an open end 201 which is divergent to allow easy mating with the pins 190 and 192. The channel extends longitudinally and has two right angle channel arms 202 and 204 spaced the same distance apart as the pins. In operation, the sleeve may be quickly and easily engaged with the core and just as quickly and easily disengaged when the sleeve contains a roll of quilted border. To engage, the channel 200 is aligned with the pins 190, 192 and the sleeve is pushed longitudinally over the core until the pins align with the channel arms 202, 204. At that time, the sleeve is rotated relative to the core about 90°, thereby locking the sleeve onto the core. To disengage, the process is reversed. The sleeve is rotated relative to the core by about 90° about its longitudinal axis and then pulled in a direction parallel to the axis of the sleeve away from the core until the channel clears the pins.

Each sleeve also includes an L-shaped retention bar 210 that is fabricated from an aluminum rod. The retention bar is engaged with the sleeve through radially drilled holes 212 and 214 in the sleeve and is attached to the sleeve by welding. The longer section of the retention bar serves to retain the first portion of a quilted border strip exiting the quilting machine. The strip is doubled backed and passed between the surface of the sleeve and the bar. The shorter section of the retention bar along with the end of the sleeve serves as a handle by which an operator can remove the sleeve when it contains a finished roll of quilted border material.

Each wind-up station also includes a guide plate such as the guide plate 124, FIG. 10 and a stiffening washer 220. The guide plate and the washer are attached to the core 142 by threaded fasteners. The guide plate serves to help align the winding border strip into a uniform, finished roll on the sleeve 140. The washer provides additional strength and rigidity to the guide plate. The guide plate and the washer are fastened to the core, and the core is attached to the arm by the core shaft 172, which engages the two pillow-block bearings 166, 168. The core shaft is retained by the pillow block bearings by a shaft collar 222, FIG. 11.

Turning to FIGS. 18, 19, 20 and 21, each of the wind-up stations, excluding the stations positioned vertically over the main shaft, is supported by a leg, such as the legs 54, 56, 58 and 60, FIG. 4. The two wind-up stations 42, 46 that are mounted at sixty degrees to each side of the vertical station 44 and are also laterally displaced. Both stations are supported by the longer legs 58, 60. The stations 40, 48 which are mounted about one hundred and twenty degrees from the vertical station 44 are supported by shorter legs 54, 56. Each leg has a caster, such as the caster 230 of the shorter leg 54 and the caster 231 of the longer leg 58. Each leg also includes an adjustable caster mount, such as the mount 232 of the shorter leg and the mount 233 of the longer leg. The adjustable legs provide additional support for the wind-up stations to insure that the weight of the stations do not strip the main shafts. The use of casters also allows each wind-up station to be slidably adjusted along the main shaft by a single machine operator. At the ends of the legs opposite the casters are mounting plates, such as the plate 234 on the leg 54 and the plate 236 on the leg 58, for attachment to a support arm.

Figure 22:
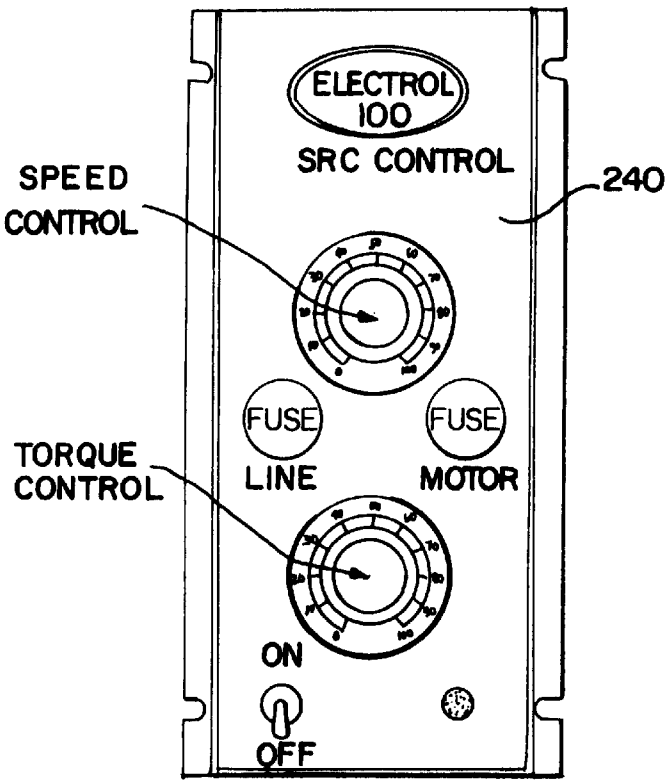
FIG. 22 is a front elevational view of a DC motor controller used in the present inventions.

Referring to FIGS. 11 and 22, each wind-up station is powered by the DC gear motor 126, 128 manufactured by Electrol (specifications: ⅛ hp, 10.8 rpm, 90V). The speed of each motor is controlled by the variable speed DC motor controller 240 that is also manufactured by Electrol, Model No. C-MH-C-100-E-A51.

All motors are energized by a motor starter that is manufactured by Allen Bradley, Model No. 100-A24ND3 (specifications: 24 amp, 115V, 1 P, 120V/60 Hz). In order to transmit power to the wind-up stations, the drive shaft of each motor is connected to the chain and sprocket assembly. The chain and sprocket assembly is manufactured by Gates (specifications: pulley, 25 grooves, 2.506 pitch diameter; matching poly-chain). The lower sprocket 130 is attached to the drive shaft 158 of the motor/gear and the upper sprocket 132 is attached to the core shaft 172. The poly-chain 134 is attached to both sprockets, and all of these items are disposed within the interior of the supporting arm.

In operation, the border winder apparatus is mounted in-line, production-wise, with a quilting machine. Individual, pre-cut rolls of ticking and associated border material such as foam and backing material are fed into the quilting machine. After a predetermined length of finished border material has exited the quilting machine, the quilting machine is turned off. The positions of the wind-up stations are adjusted to correspond to the number and widths of the individual pieces of quilted ticking exiting the quilting machine. These adjustments are made by loosening the set-screws that are contained in the hubs of the supporting arms and by sliding the wind-up stations into position. (The radial positions on the stations are also predetermined and set.) The separate strips of quilted border material are individually fed onto preselected wind-up stations and each strip is secured to a sleeve by the retention bar. Thereafter, both the quilting machine and the border winder apparatus are activated. The individual DC motor controllers are adjusted, if necessary, to ensure a uniform tension on each strip of border material as that material is wound.

At such time as an individual roll (or rolls) of border is completed, the respective wind-up station may be stopped, and the operator may remove the finished roll by removing the sleeve from the core. This allows an operator to remove a short run of border material without having to shut down all of the wind-up stations. Indeed, the remainder of the winding operation proceeds uninterrupted as does the quilting operation.

Also, a new strip of ticking may be introduced to the quilting machine and the winder apparatus so that an individual roll of ticking may be fed into the process during the ongoing production of other quilted border strips. This attribute of the winder apparatus offers an advantage by allowing an operator to insert a new ticking type or a ticking of a different dimension into an existing run of quilted border material without waiting until the end of that run.

Figure 23:
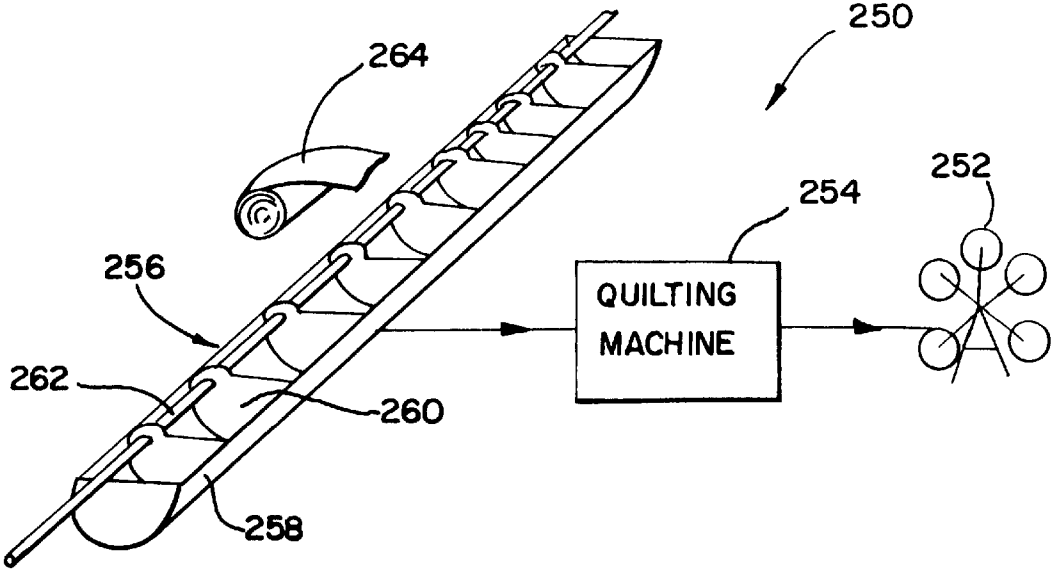
FIG. 23 is a diagrammatic view of a quilted border system of the present invention.

Referring now to FIG. 23, there is illustrated a quilted border system comprising the quilted border winder apparatus 252 attached to the output of a quilting machine 254. The quilting machine, in turn, is fed by a ticking support station 256 which comprises a trough 258 which is divided along its length by a series of dividers, such as a divider 260. Each of the dividers is movable in a direction parallel to the longitudinal axis of a divider mounting bar 262. Also, the dividers may be rotated about the longitudinal axis of the divider mounting bar 262. The traditional ticking support station has no dividers and accepts an approximately eight foot wide roll of ticking which is then mated with one or more layers of foam and backing material before entering the quilting machine.

As shown in FIG. 23, a much narrower roll 264 may be placed in the trough between two of the dividers or between a divider and a trough end wall. Each of the rolls is aligned and then sent through the quilting machine where it exits stitched to the one of more layers of foam and backing material. At that time the foam and backing material are cut forming strips of quilted ticking. The winding apparatus 252 is aligned to receive each strip of quilted ticking and roll that strip on one of the take-up reels as previously explained.

It is to be understood that unlike the traditional method of manufacturing quilted ticking, any one of the narrow strips of ticking, such as the roll 264, may be changed without altering the other strips already in the process of being quilted.

As mentioned earlier, there are numerous advantages achieved by the described system, method and apparatus. It has been calculated that productivity increases by approximately 50 percent. Before the invention described here, typical yardage production per shift was approximately 250–300 yards. With the system described here yardage has increased to 550–600 per shift. Inventory has been reduced by some 88 percent. With the flexibility of the current system, an operator can more accurately run a specific ticking material in the amount actually required rather than running six to ten times the amount needed. Reducing inventory frees up floor space and eliminates spoilage from dirty or damaged quilted borders.

Another advantage is that if one or two quilted borders are needed immediately, it is easy to remove one strip of ticking and replace it with another. There is also an 88 percent reduction in material handling because only those rolls which are specifically ordered are placed on the machine.

Finally, by running longer single, narrow rolls of ticking rather that short, multiple rolls there is less splicing required when strips are brought together. Also, run-back skips have been substantially reduced. Thus, quality control has been improved.

In addition to the above-mentioned advantages, the apparatus has the following attributes. Every take-up reel may be adjusted for speed changes required during the time that a quilted border is collected around the reel. Each reel mounted on its respective arm may be laterally adjusted easily and quickly along the horizontally disposed hexagonal shaft.

Another advantage is that each trough and each take-up reel accepts quilted borders that can vary from 7 to 15 inches in width. Another aspect of the present invention is that the light weight removable sleeves allow for quick changeover. The quarter-turn locking mechanism requires no fasteners and no tools. Finally, the pulleys and belts of the drive are enclosed within the individual arms for a safe, clean, operating environment.

The specification describes in detail an embodiment of the present invention. Other modifications and variations will, under the doctrine of equivalents, come within the scope of the appended claims. For example, a different drive mechanism might be used instead of the sprocket and chain mechanism described. A different retention mechanism might be used with the sleeves. Or, the main shafts may not have a hexagonal cross-section. Main shafts having a square cross-section or even round cross-sections are considered equivalent structures. In a like fashion a geared power transmission might be used. These are all considered equivalent structures. Still other alternatives will also be equivalent as will many new technologies. There is no desire or intention here to limit in any way the application of the doctrine of equivalents.

We claim:

1. A quilted border winder apparatus comprising:

a base;

a plurality of take-up reels, each of said reels positioned to receive a quilted strip of ticking and other material;

means mounted to said base for supporting said take-up reels; and means supported by said base for rotating each take-up reel independently; said supporting means including a plurality of arms, each arm connected at a first end to one of said plurality of take-up reels.

2. An apparatus as claimed in claim 1 wherein:

said rotating means include a plurality of motors and a plurality of drive means for transmitting motion from said motors to said take-up reels, each motor and drive means being mounted to an arm.

3. An apparatus as claimed in claim 2 wherein:

said base includes a horizontal shaft for supporting a plurality of arms in spaced relationship one from the other in a direction parallel to the longitudinal axis of said shaft.

4. An apparatus as claimed in claim 3 wherein:

said shaft has a hexagonal cross-sectional shape.

5. An apparatus as claimed in claim 4 wherein:

said shaft supports at least some of said arms in a radially spaced relationship one from another.

6. An apparatus as claimed in claim 3 wherein:

each of said take-up reels includes a core connected to a respective arm and a sleeve slidably mounted to said core.

7. An apparatus as claimed in claim 6 wherein:

each of said sleeves and cores has a locking mechanism for allowing locking engagement between mating sleeves and cores.

8. An apparatus as claimed in claim 7 wherein:

said locking mechanism comprises a pair of aligned pegs connected to said core and a slot formed in said sleeve, said slot having a main channel and two lateral channels disposed perpendicular to said main channel for receiving said pegs whereby said sleeve may be attached to said core and unattached therefrom by hand without the need for tools.

9. An apparatus as claimed in claim 8 wherein:

at least two of said take-up reels are mounted whereby said reels have axes of rotation parallel to said shaft but are laterally offset therefrom; and including a plurality of legs each leg for supporting a laterally offset take-up reel.

10. An apparatus as claimed in claim 3 including:

a second shaft supported by said base and having a longitudinal axis parallel to the longitudinal axis of said first mentioned shaft and laterally offset therefrom.

11. An apparatus as claimed in claim 10 including:

an electrical conduit connected to said base and positioned parallel to the first mentioned and second shafts and in communication with said plurality of motors.

12. An apparatus as claimed in claim 11 wherein:

said second shaft supports a plurality of arms in spaced relationship one from the others in a direction parallel to the longitudinal axis of said second shaft;

both of said shafts have a hexagonal cross-sectional shape;

each of said take-up reels includes a core connected to a respective arm and a sleeve slidably mounted to said core;

each of said sleeves and cores has a locking mechanism for allowing locking engagement between mating sleeves and cores;

said locking mechanism comprises a pair of aligned pegs connected to said core and a slot formed in said sleeve, said slot having a main channel and two lateral channels disposed perpendicular to said main channel for receiving said pegs whereby said sleeve may be attached to said core and unattached therefrom by hand without the need for tools;

at least two of said take-up reels are mounted whereby said reels have axes of rotation parallel to said shafts but are laterally offset therefrom; and including a plurality or legs each leg for supporting a laterally offset take-up reel.

13. A method of quilting borders for mattresses comprising the steps of:

providing a plurality of individual ticking strip rolls;

providing a roll of other material to be quilted;

placing said plurality of ticking strip rolled in a divided support structure, each roll separated from another;

quilting said strips of ticking and said other material in a quilting machine;

separating each quilted strip of ticking and other material from other quilted strips of ticking and other material;

independently rolling each separated quilted strip of ticking and other material on a winding apparatus; and independently removing a quilted roll from said winding apparatus.

14. A method as claimed in claim 13 including the steps of:

aligning each of said ticking strip rolls prior to said quilting step;

providing a winding apparatus having a plurality of take-up reels, one for each quilted ticking strip; and aligning each take-up reel with each quilted ticking strip.

15. A method as claimed in claim 14 including:

aligning a roll of ticking prior to quilting said ticking and during the quilting of another roll of ticking.

16. A method as claimed in claim 15 including the step of:

removing a roll of quilted ticking from said winding machine during the quilting of another ticking roll.

17. A method as claimed in claim 16 wherein:

said plurality of ticking rolls is within the range of 6 to 10.

18. A quilted border system comprising:

a ticking support station having dividers for separating rolled strips of ticking;

a quilting machine operatively connected to said ticking support station for connecting said strips of ticking to other material to form quilted borders;

cutting means operatively connected to said quilting machine for separating each quilted border strip prior to winding; and an apparatus having a plurality of winding stations each being separately powered and each being positioned to receive a quilted border strip independently of other quilted border strips.

19. A system as claimed in claim 18 wherein:

said apparatus comprises a base, a plurality of take-up reels, each of said reels positioned to receive a quilted strip of ticking and other material, means mounted to said base for supporting said take-up reels, and means supported by said base for rotating each take-up reel independently.

20. A system as claimed in claim 19 wherein:

said supporting means includes a plurality of arms, each arm connected at a first end to one of said plurality of take-up reels;

said rotating means includes a plurality of motors and a plurality of drive means for transmitting motion from said motors to said take-up reels, each motor and drive means being mounted to an arm; and said base includes a horizontal shaft, said shaft for supporting a plurality of arms in spaced relationship one from the others in a direction parallel to the longitudinal axis of said shaft.

21. A system as claimed in claim 20 wherein:

said shaft has a hexagonal cross-sectional shape;

said shaft supports at least some of said arms in radially spaced relationship one from another;

each of said take-up reels includes a core connected to a respective arm and a sleeve slidably mounted to said core; and a locking mechanism for said core and said sleeve comprising a pair of aligned pegs connected to said core and a slot formed in said sleeve, said slot having a main channel and two lateral channels disposed perpendicular to said main channel for receiving said pegs whereby said sleeve may be attached to said core and unattached therefrom by hand without the need for tools.

22. A system as claimed in claim 21 wherein:

at least two of said take-up reels are mounted whereby said reels have axis of rotation parallel to said shaft but are laterally offset therefrom; and including a plurality of legs, each leg for supporting a laterally offset take-up reel;

a second shaft supported by said base having a longitudinal axis parallel to the longitudinal axis of said first mentioned shaft and laterally offset therefrom; and an electrical conduit connected to said base and positioned parallel to the first mentioned and second shaft and in communication with said plurality of motors.

* * * * *